US005156344A

United States Patent [19]

Tippett

[11] Patent Number: 5,156,344

[45] Date of Patent: Oct. 20, 1992

[54] DISPENSER APPARATUS

[76] Inventor: J. P. Tippett, 423 Riviera Bay Dr., NE., St. Petersburg, Fla. 33702

[21] Appl. No.: 642,286

[22] Filed: Jan. 17, 1991

[51] Int. Cl.[5] ..... B02C 19/00

[52] U.S. Cl. ..... 241/46.017; 241/74; 241/199.12; 366/264

[58] Field of Search ..... 241/74, 277, 2, 46 B, 241/199.12, 46.017; 366/263, 264, 176

[56] References Cited

U.S. PATENT DOCUMENTS 2,578,805 12/1951 Johnson ..... 366/264 X
3,726,487 4/1973 Fraser ..... 241/294 X
4,197,019 4/1980 Schold ..... 366/294
4,347,004 8/1982 Platts ..... 366/264 X
4,854,720 8/1989 Schold ..... 366/294

*Primary Examiner*—Timothy V. Eley
*Assistant Examiner*—Frances Chin
*Attorney, Agent, or Firm*—Frank R. Thienpont

[57] ABSTRACT

A mixing machine for dispersing finely divided solid particles in a liquid vehicle including an agitator shaft, a rotor stator assembly, a plurality of stator support rods, variable flow restrictor means being associated with the stator portion and a second variable flow restrictor means being associated with the rotor stator assembly.

9 Claims, 4 Drawing Sheets

DISPENSER APPARATUS

BACKGROUND OF THE INVENTION

This invention relates to dispersing machines for dispersing solid particles in a liquid vehicle.

Machines of this general type are disclosed, for example, in Schold U.S. Pat. No. 4,197,019 issued Apr. 8, 1980 and Schold U.S. Pat. No. 4,854,720 issued Aug. 8, 1989.

SUMMARY OF THE INVENTION

It is an object of this invention to provide in a dispersing apparatus a rotor-stator device which is effective to produce increased liquid material turnover to achieve more effective dispersion of solids in a liquid vehicle.

Another object is to provide a rotor-stator device with flow-restrictor means to achieve the foregoing object.

Still another object of the invention is to provide in the rotor stator assembly stator support rods which may be adjustably positioned to further affect the flow and turnover of material being mixed in the disperser.

Other objects and advantages of this invention will become more apparent from reading the following description in connection with the accompanying drawings.

DESCRIPTION OF THE PREFERRED EMBODIMENT

Figure 2:
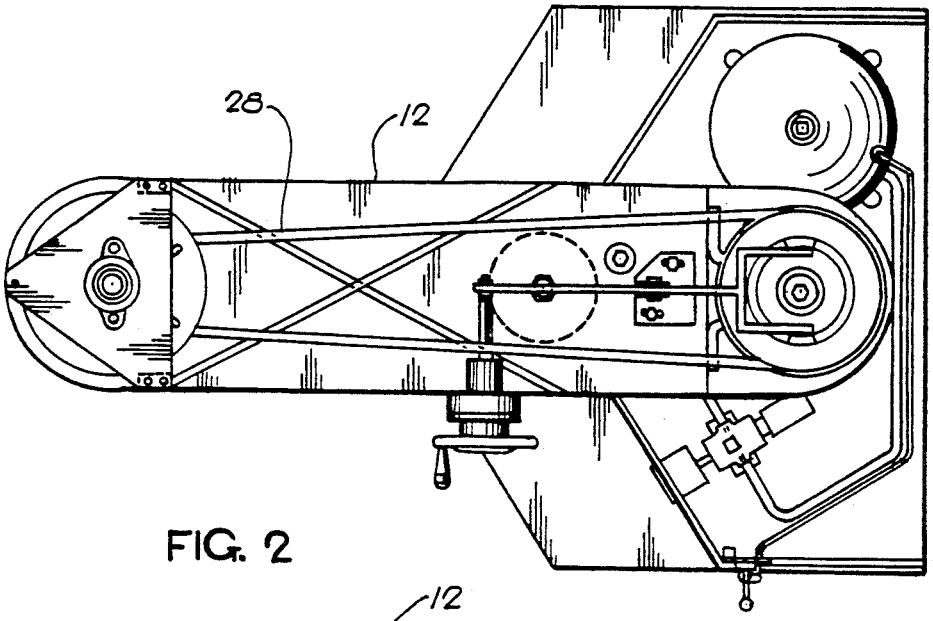
FIG. 2 is a top plan view of the apparatus of FIG. 1.
Figure 1:
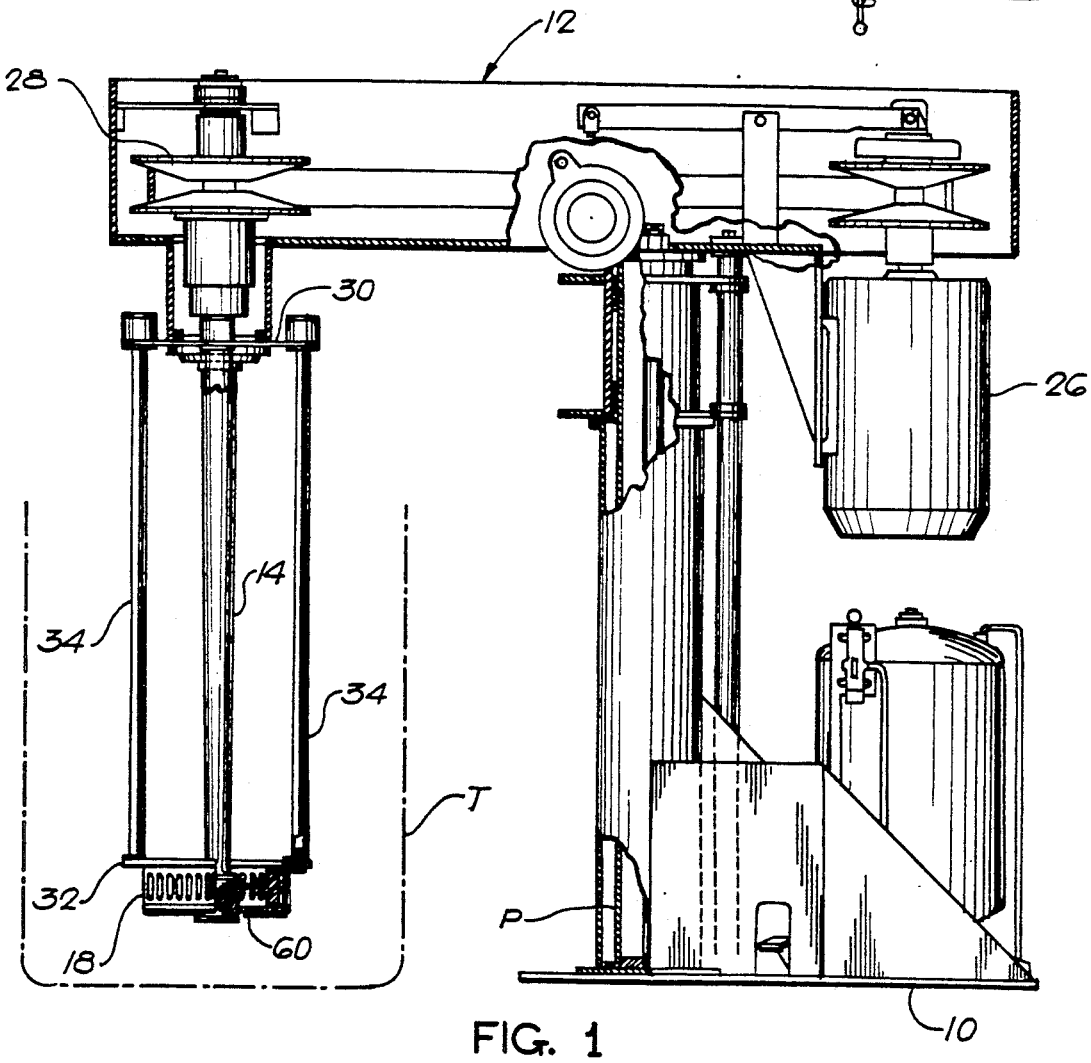
FIG. 1 is a side view of a dispersing apparatus embodying the invention herein.

Referring now to the drawings; FIGS. 1 and 2 illustrate the over-all dispersing apparatus including a base or mounting frame 10, a motor drive assembly 12, an agitator shaft 14 drivingly connected to the motor drive assembly, a stator assembly 18 connected to and supported by the mounting frame, and a rotor assembly 20 connected to and driven by the agitator shaft 14. The apparatus also includes a variable vent ring 40 associated with the stator assembly 18 and a variable bypass restrictor plate 70 which cooperates with openings in a bearing support plate secured to the lower edge of a stator ring.

The motor drive assembly 12 may include a variable speed motor 26 for driving the agitator shaft 18 through a belt and variable speed pulley arrangement 28.

The agitator shaft and rotor-stator assembly may be lowered into an operating position in an associated mixing tank T shown in phantom in FIG. 1 by means of the associated hydraulic piston P.

The stator assembly 18 includes an upper stator support plate 30, a lower stator support plate 32, a plurality of stator support rods 34 interconnecting the upper and lower stator support plates 30 and 32 and a stator ring 36 attached to the lower stator support plate.

Figure 3:
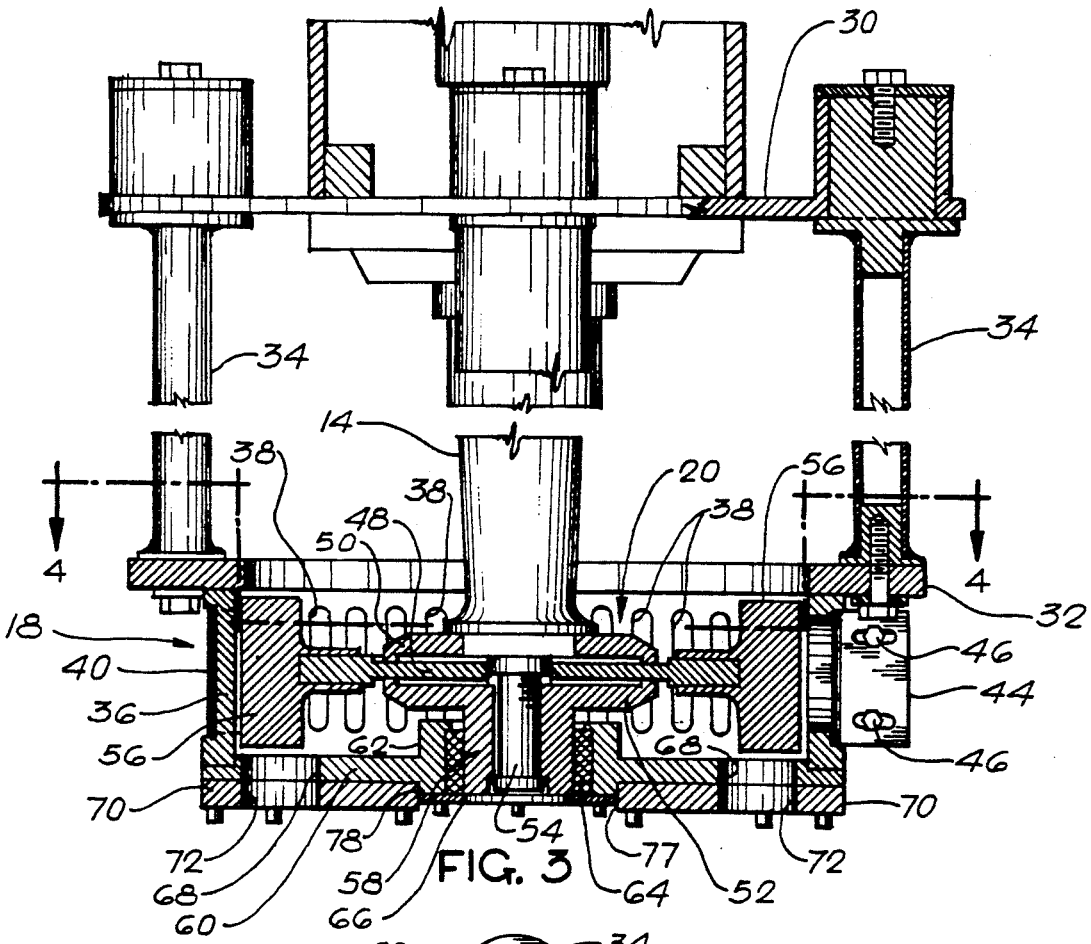
FIG. 3 is an enlarged view in elevation of the rotor-stator assembly shown partially in section.

The upper stator support plate 30 which may be constructed in annular form, surrounds the agitator shaft 14 and is secured to a portion of the mounting frame as best seen in FIG. 3. A plurality of stator support rod bearings 37 are connected to the upper face of the support plate 30. As here shown, four such bearings 37 are connected to the plate 30 spaced 90° apart to accommodate four stator support rods.

The lower stator support plate 32 is connected to the upper edge of the stator ring 36 by suitable means such as bolts 39 and also to the lower ends of the stator support rods 34 in such a manner as to provide a pivotal support for the stator support rods 34 in the support plate.

Figure 4:
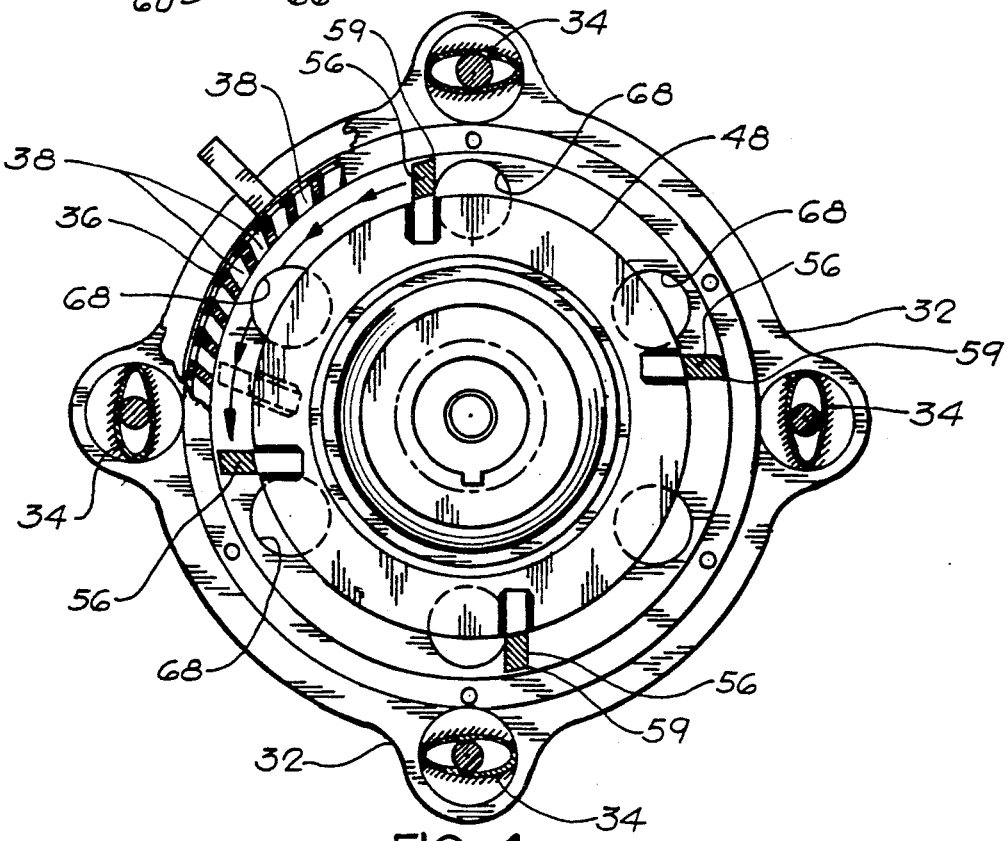
FIG. 4 is a top plan view partially in section of the rotor-stator assembly taken along line 4—4 of FIG. 3.
Figure 5:
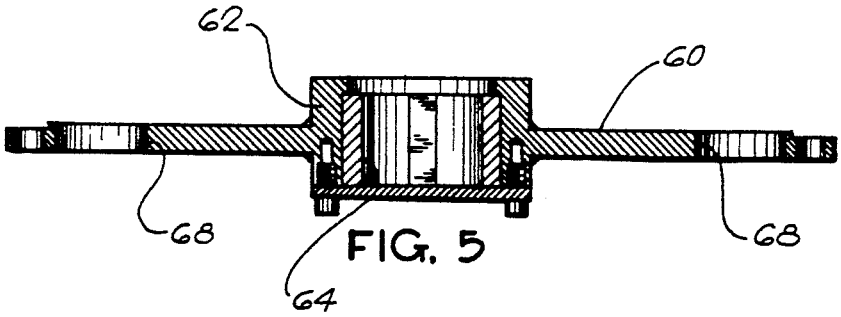
FIG. 5 is a cross-sectional view in elevation of a bearing support plate, which is part of the rotor-stator assembly.
Figure 6:
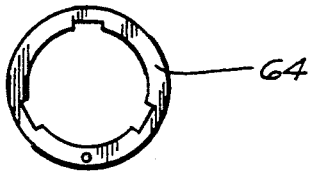
FIG. 6 is a plan view of a bearing which is part of the rotor-stator assembly.
Figure 7:
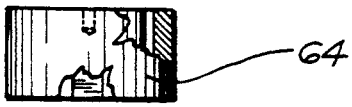
FIG. 7 is a view in elevation partially in section of the bearing of FIG. 6.
Figure 8:
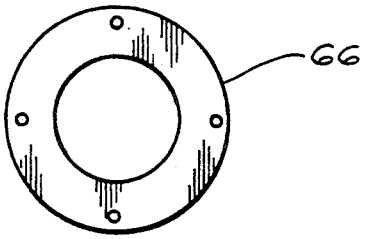
FIG. 8 is a plan view of a bearing retainer plate.
Figure 9:
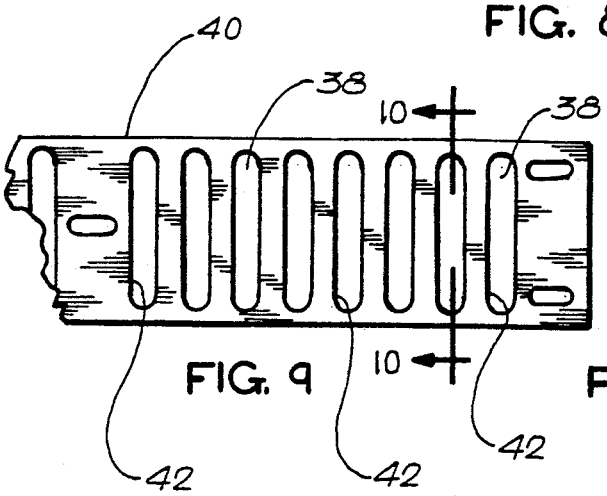
FIG. 9 is a view in elevation of a portion of a variable vent ring which surrounds the stator ring in the rotor-stator assembly.
Figure 10:
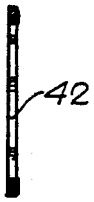
FIG. 10 is a sectional view in elevation of the vent ring taken along line 10—10 of FIG. 9.
Figure 11:
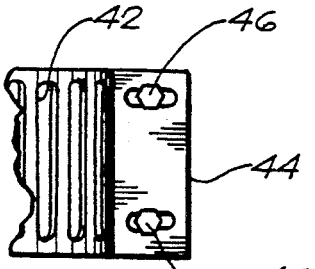
FIG. 11 is a view in elevation of a portion of the vent ring of FIG. 9 illustrating vent ring adjusting means.
Figure 12:
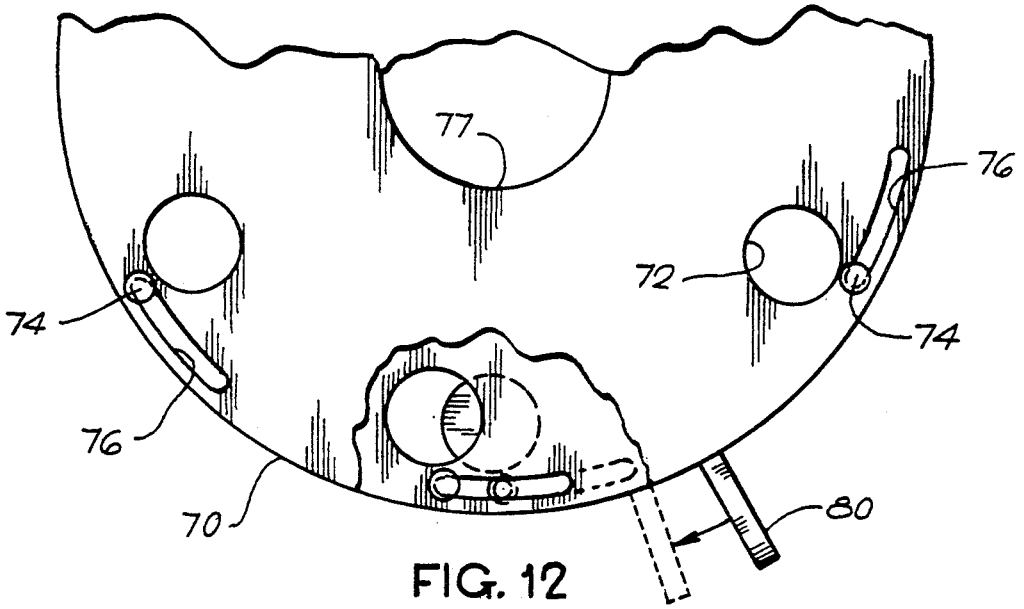
FIG. 12 is a bottom plan view of a variable by-pass restrictor plate adjustably attached to the lower face of the bearing support plate.
Figure 13:
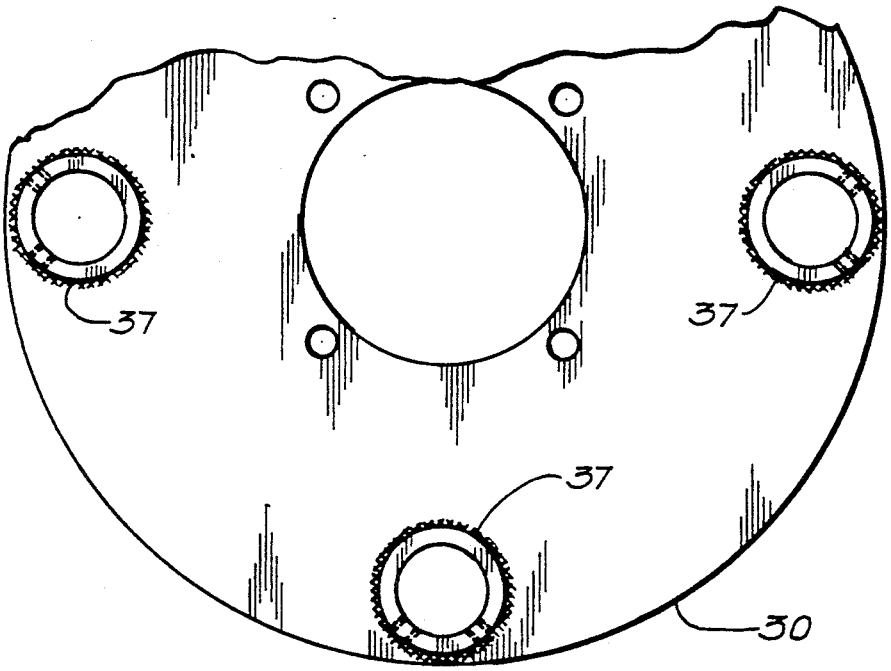
FIG. 13 is a top plan view of the upper stator support plate.
Figure 14:
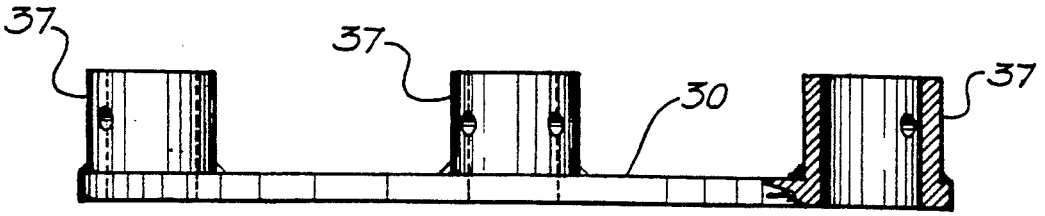
FIG. 14 is an elevation view partially in section, of the upper stator support plate of FIG. 13.

The stator support rods 34 preferably are formed with an air foil cross-section as best seen in FIG. 4. They are pivotally mounted in the upper stator support plate 30 and lower stator support plate 32 and may be rotatably adjusted to any angle to accommodate the flow of the particular material being processed.

The stator ring 36 is secured at its upper edge to the lower stator support plate 32. The stator ring 36 preferably is made of heavy wall steel tubing or stainless steel tubing of approximately ¾" thickness. The stator ring 36 is formed with a plurality of circumferentially spaced slots 38 through which the material flows when it is being processed, the slots contributing to the agitation and shearing effect to help achieve proper dispersion of the solid material in the liquid vehicle.

In order to further control the agitation and shearing effect a first restrictor means is provided to effectively adjust the size of the slot openings 38 depending on the type of material being processed. This restrictor means includes a relatively thin circumferentially adjustable band or ring member 40 which surrounds the stator ring 36. A plurality of openings 42 are formed in the ring member 40, the openings 42 being the same in number as the slots 38 in the stator ring. The position of the ring member 40 may be adjusted from fully open to a fully closed position. Thus, the ring member 40 may be positioned in a fully open position to have all the openings 42 and slots 38 of the stator ring in register so as to allow full flow through the stator ring. Tab portions 44 are formed at the free ends of the restrictor ring 40 and are secured together by bolts 46 or other suitable fastening means to secure the restrictor band 40 in place at the desired position around the stator ring 36.

The rotor assembly 20 includes rotor disk 48 which may be in the form of a relatively flat blade. It is secured to the agitator shaft 14 by a drive flange 50 and a clamp flange 52 disposed on the upper and lower sides respectively of the rotor disk. A securing bolt 54 extends through the clamp flange 52 into the lower end of the agitator shaft 14 to secure the rotor disk 48 to the shaft 14. A plurality of cutter blades 56 as best shown in FIGS. 3 and 4 are secured in the outer periphery of the rotor disk. The number may vary, but, as here shown, four of such blades equally spaced about the periphery will give satisfactory performance. The height or vertical dimension of the cutter blades preferably is slightly greater than the vertical dimension of adjacent slots 38 in the stator ring 36.

The clamp flange 52 is constructed with an axially extending boss 58 which in effect forms a coaxial extension of the agitator shaft 14. This boss 58, as will be further explained, serves as a shaft centering device and inhibits shaft vibrations.

The relative construction of the stator ring 36 and the rotor disk 48 is such that the outer leading edges 59 of the cutter blades 56 are in close proximity to the inside diameter (I.D.) of the stator ring. Preferably this distance is in the area of ⅛" or less where the rotor diameter is approximately ten to eleven inches in diameter. It will be appreciated that the rotation of the rotor disk 48 and the close proximity of the cutter blades 56 to the I.D. of the stator during operation of the disperser tend to force the material being mixed through the slots 38 in the stator ring 36. In the mixing process a tremendous shearing effect occurs as the material is forced through the slots 38 thus resulting in improved dispersion of the solids in the liquid vehicle.

An annular bearing support plate 60 is connected by bolts or other suitable means to the lower edge of stator ring 36. Formed at its center is a bearing housing 62 in which is positioned bearing member 64. A bearing retainer plate 66 which is removably secured by bolts or the like to the underside of the bearing housing secures the bearing 64 in place. The bearing 64 provides a bearing surface for the boss 58 of the clamp flange 52. Thus, in the operation of the disperser potential vibrations of the shaft 14 are substantially inhibited by the bearing 64.

A plurality of openings 68 extend through the bearing support plate. These openings 68 are designed to permit additional free flow of material during the mixing process. As here shown, six equally circumferentially spaced openings are used, but that number may be varied.

A second flow restrictor means in the nature of restrictor plate 70 is provided in association with the bearing support plate. The restrictor plate 70 is of annular construction and is provided with a plurality of equally spaced openings 72 (the same number as in the bearing support plate). It is attached to the bearing support plate 60 at the underside thereof for slideable rotating movement relative to the bearing support plate. The attachment, as here shown, is by a plurality of bolt 74 and groove 76 connections. The restrictor plate 70 is formed with a central opening 77 so that it fits over the annular shoulder 78 formed on the lower end of the bearing housing 62, thus being rotatable relative to the bearing support plate by means of handle 80. It will be apparent that the restrictor plate 70 may be rotated from a position wherein the openings 72 of the restrictor plate are in complete register with the openings 68 in the bearing support plates thus allowing free flow through the latter to a position wherein the openings in the bearing support plate are completely closed off. The restrictor plate 70 is used to vary the flow as desired depending, for example, on the type and viscosity of material being mixed.

It will be apparent that there has been provided in a material dispersing apparatus a rotor stator assembly in which the dispersion of the solid particles in the liquid vehicle can be much enhanced by the control and variation of the flow of material being processed. First and second variable flow restrictor means have been provided in conjunction with the rotor-stator assembly to accommodate materials of various types and viscosities. In addition, the provision of rotatably adjustable stator rods of air-foil cross-section further contribute to the overall mixing process.

While a preferred embodiment of the invention has been disclosed, it will be appreciated that this is shown by way of example only, and the invention is not to be limited thereto as other variations will be apparent to those skilled in the art and the invention is to be given its fullest possible interpretation within the terms of the following claims.

What is claimed is:

1. Apparatus for dispersing solid particles carried in suspension in a liquid vehicle comprising:

(a) a rotatable agitator shaft;

(b) a motor drive assembly for driving said agitator shaft;

(c) a mounting frame for carrying said motor drive assembly;

(d) a stator assembly carried by said mounting frame, said stator assembly including (1) a plurality of vertically extending stator support rods extending from said mounting frame, (2) a stator ring attached to the lower ends of said stator support rods, (3) means defining a plurality of radially extending openings formed in said stator ring, (e) first flow restrictor means attached to said stator ring for effectively varying the size of said openings in said stator ring to thereby control the flow of material therethrough, said flow restrictor means comprising a stationary rotatably adjustable vertically extending vent ring member surrounding and disposed closely adjacent said stator ring;

(f) a rotor assembly connected to the lower end of said agitator shaft and positioned in said stator ring, said rotor assembly including (1) a rotor disk attached to the lower end of said agitator shaft;

(2) a plurality of cutter blades secured to the periphery of said disk, the outer edges of said cutter blades in the assembly being positioned in close proximity to the inside surface of said stator ring to provide in operation a shearing effect with said stator ring;

(g) an annular horizontally extending bearing support plate secured to the lower portion of said stator ring, said bearing support plate having a plurality of openings extending therethrough;

(h) bearing means supported in said bearing support plate;

(i) means connected to said agitator shaft and disposed in said bearing means for centering said agitator shaft;

(j) second flow restrictor means operatively associated with said bearing support plate for restricting the flow of material through said openings in said bearing support plate, said second flow restrictor means comprising a rotatably adjustable annular plate mounted adjacent said support plate.

2. Apparatus for dispersing solid particles carried in suspension in a liquid vehicle comprising:

(a) a rotatable agitator shaft;

(b) a motor drive assembly for driving said agitator shaft;

(c) a mounting frame for carrying said motor drive assembly, (d) a stator assembly carried by said mounting frame, said stator assembly including (1) a plurality of vertically extending stator support rods extending from said mounting frame, (2) a stator ring attached to the lower ends of said stator support rods, (3) means defining a plurality of radially extending openings formed in said stator ring, (e) first flow restrictor means attached to said stator ring for effectively varying the size of said openings in said stator ring to thereby control the flow of material therethrough, said flow restrictor means comprising a stationary rotatably adjustable vertically extending vent ring member;

(f) a rotor assembly connected to the lower end of said agitator shaft and positioned in said stator ring, said rotor assembly including (1) a rotor disk attached to the lower end of said agitator shaft, (2) a plurality of cutter blades secured to the periphery of said disk, the outer edges of said cutter blades in the assembly being positioned in close proximity to the inside surface of said stator ring to provide in operation a shearing effect with said stator ring;

(g) an annular horizontially extending support plate secured to the lower portion of said stator ring, said support plate having a plurality of openings extending therethrough;

(h) shaft centering means connected to said support plate;

(i) second flow restrictor means operatively associated with said support plate for adjustably restricting the flow of material through said openings in said support plate, said second flow restrictor means comprising rotatably adjustable plate means positioned adjacent said support plate.

3. The apparatus of claim 2 wherein said first flow restrictor means comprises a vertically extending stationary vent ring member including means defining a plurality of radially extending slots formed in said vent ring member, said vent ring member being concentrically disposed around said stator ring and circumferentially movable through a range of positions from a position wherein said slots are in register with said openings in said stator ring to a position wherein said openings in said stator ring are completely closed and cut off to flow of material being processed.

4. The apparatus of claim 3 including adjusting means attached to said vent ring member for effecting circumferential movement thereof.

5. The apparatus of claim 2 wherein said second flow restrictor means comprises a rotatably adjustable horizontally extending annular plate rotatably mounted adjacent said support plate for effectively varying the size of said openings in said support plate.

6. The apparatus of claim 2 wherein said second flow restrictor means comprises a rotatably adjustable annular plate having a plurality of openings formed therein and rotatably mounted adjacent said support plate for effectively varying the size of said openings in said support plate, said adjustable annular plate being rotatable through a range of positions from a position wherein said openings therein are in register with said openings in said support plate to a position wherein said openings in said support plate are completely blocked.

7. The apparatus of claim 2 wherein said stator support rods are of a generally air foil cross-section.

8. The apparatus of claim 7 including means associated with said air-foil shaped stator support rods for adjustably rotating them relative to the stator ring for varying the attitude of said support rods with respect to the flow of material during a mixing operation.

9. The apparatus of claim 8 wherein the ends of said air-foil shaped rods are journaled in said upper and lower stator support plates to allow for rotatably adjusting the position of said rods to assume varying attitudes with respect to the flow of material during a mixing operation.

* * * * *

UNITED STATES PATENT AND TRADEMARK OFFICE

CERTIFICATE OF CORRECTION

PATENT NO. : 5,156,344

DATED : Oct. 20, 1992

INVENTOR(S) : J. P. Tippett

It is certified that error appears in the above-indentified patent and that said Letters Patent is hereby corrected as shown below:

On the Title page, item [54], Title: should be --DISPERSER APPARATUS--.
Column 1, line 1, should be the same--.

Signed and Sealed this

Twenty-sixth Day of July, 1994

Bruce Lehman

*Attest:*

BRUCE LEHMAN

*Attesting Officer*

*Commissioner of Patents and Trademarks*